US008464828B2

(12) United States Patent
Takeda et al.

(10) Patent No.: US 8,464,828 B2
(45) Date of Patent: Jun. 18, 2013

(54) OPERATION UNIT FOR CONSTRUCTION MACHINE AND HOSE COVER TO BE PROVIDED THEREIN

(75) Inventors: Kazuyuki Takeda, Hiroshima (JP); Satoshi Kurushima, Hiroshima (JP); Daiki Nakabayashi, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 0 days.

(21) Appl. No.: 13/279,674

(22) Filed: Oct. 24, 2011

(65) Prior Publication Data

US 2012/0104798 A1 May 3, 2012

(30) Foreign Application Priority Data

Oct. 28, 2010 (JP) ..... 2010-242295

(51) Int. Cl.
*B60K 26/00* (2006.01)

(52) U.S. Cl.
USPC ..... 180/326; 150/154; 180/329

(58) Field of Classification Search
USPC ..... 180/326, 329, 327, 328; 150/154, 150/159, 901
See application file for complete search history.

(56) References Cited

FOREIGN PATENT DOCUMENTS

| | | |
|---|---|---|
| JP | 6-12557 U | 2/1994 |
| JP | 11-215641 | 8/1999 |
| JP | 2004-222471 | 8/2004 |
| JP | 2007-162240 | 6/2007 |
| JP | 2010-90589 | 4/2010 |

OTHER PUBLICATIONS

Extended European Search Report issued Feb. 23, 2012, in Patent Application No. 11186841.0.

*Primary Examiner* — Eric Culbreth
(74) *Attorney, Agent, or Firm* — Oblon, Spivak, McClelland, Maier & Neustadt, L.L.P.

(57) ABSTRACT

An operation unit for a construction machine includes a floor, an operation seat and a console box. A pilot valve is provided within the console box, a plurality of hoses are connected to the pilot valve and arranged at least from the pilot valve to the floor while bundled together, and a hose cover covers a plurality of over-floor portions of the respective hoses between the pilot valve and the floor.

6 Claims, 5 Drawing Sheets

OPERATION UNIT FOR CONSTRUCTION MACHINE AND HOSE COVER TO BE PROVIDED THEREIN

BACKGROUND OF THE INVENTION

1. Field of the Invention

The present invention relates to an operation unit for a construction machine, the operation unit comprising a floor, an operation seat provided on the floor and a console box provided on a lateral side of the operation seat. The present invention also relates to a hose cover for covering respective over-floor portions of a plurality of hoses connected to a pilot valve within the console box, i.e., a portion of the hose from the floor to the console box.

2. Description of the Background Art

The background art of the present invention will be described by taking a hydraulic shovel as an example.

A hydraulic shovel generally comprises a crawler-type lower propelling body, an upper slewing body mounted on the lower propelling body, and a working attachment attached to the upper slewing body, wherein the upper slewing body is provided with an operation unit.

FIGS. 10 and 11 show an upper slewing body of a hydraulic shovel, which is an open type having an operation unit exposed to the outside. This operation unit comprises a floor F, an operation seat 1 provided above the floor F, and two console boxes 2, 3 provided on left and light sides of the operation seat 1, respectively; each of the console boxes 2, 3 is provided with a working manipulation device comprising a control lever 4 and a pilot valve 5 adapted to be operated by the control lever 4. Furthermore, a control lever 6 and a pedal 7 are provided on the floor F at a position in front of the operation seat 1.

As used in this specification, the terms "front (frontward)", "rear (rearward)", "right (rightward)" and "left (leftward)" mean respective directions as seen from an operator seated in the operation seat 1.

The left console box 2 of the two console boxes 2 and 3, which is so positioned as to face an entrance, is disposed so as to prevent the console box 2, particularly the control lever 4 thereof, from disturbing getting-on or getting-off operators. Specifically, the console box 2 is supported rotationally movably about a pivot shaft 8 shown in FIG. 11, between a lowered position for a working mode, indicated by the solid line in FIG. 11, and a lifted position for a getting-on/off mode, indicated by the two-dot chain line in FIG. 11. The lifted position is located upward and rearward of the lowered position to open up the entrance. The console box 2 is set to the lifted position during getting-on/off.

There is provided a gate lever 9 on a left front side of the operation seat 1. The gate lever 9 is able to be swung in a frontward-rearward direction, like a barrier for a railroad crossing, to open and close the entrance. Specifically, the gate lever 9 is operated so as to close the entrance during working and open the entrance during getting-on/off. The gate lever 9 is generally coupled to the left console box 2 through an interlocking mechanism for interlocking between the gate lever 9 and the console box 2, thus being automatically opened and closed interlockingly with lifting and lowering of the console box 2.

The operation unit further comprises a plurality of hoses. Each of the hoses has one end connected to the pilot valve 5 within the left console box 2 and the other end connected to a control valve, a pump and a tank provided at a position away from the pilot valve 5, e.g., in an equipment compartment on a right side of the upper slewing body. On the floor F is provided a hose guide 11, which is formed in a tubular shape to guide each of the hoses from the upper side of the floor F to the lower side thereof.

The hoses are usually arranged between the pilot valve 5 and the control valve while being hidden by passing inside a seat stand supporting the operating seat 1 from therebelow and under the floor F; however, in the operation unit where the seat stand does not exist underneath the left console box 2 as illustrated in FIGS. 10 and 11, the hoses are exposed between the console box 2 and the floor F. Accordingly, in view of improving visual quality and preventing oil from littering due to hose breakage, it is desirable to cover a plurality of over-floor portions 10 which are respective portions of the hoses between the pilot valve 5 and the floor F.

FIGS. 10 and 11 illustrate only two of the over-floor portions 10, for the sake of simplification, while the number thereof is typically six.

Heretofore, as a structure for covering a hydraulic piping including hoses, there have been known a first technique disclosed in Japanese Patent Laid-Open Publication No. 2010-90589 and a second technique disclosed in Japanese Utility Model Laid-Open Publication No. 06-12557. In the first conventional technique, a halved cylindrical-shaped casing or a bellows-like member covers hoses as a cover member. In the second conventional technique, a rectangular-shaped cloth is wrapped around hoses as a cover member and held in a cylindrical shape by a tape fastener or the like. However, these conventional techniques have the following problems.

The first conventional technique, using the casing or the bellows-like member as a cover member, involves a high cost. Moreover, in the case of using the cover member for covering the over-floor portions 10, mechanical vibration may bring an inner surface of the cover member, which is generally given an inner diameter set to a relatively large value enough to loosely cover the over-floor portions 10, into intermittent contact with the over-floor portions 10, which may cause the cover member or the over-floor portions 10 to be damaged. Particularly, a rotationally movable console box such as the box 2 shown in FIGS. 10 and 11 makes a rotational movement which can cause the over-floor portions 10 to bend and stretch while strongly rubbing against the inner surface of the cover member; this increases a risk of the damage.

On the other hand, in the case of utilizing the second conventional technique to cover the over-floor portions 10, it is difficult to obtain good visual quality. Specifically, the over-floor portions 10 form a hose bundle which has an upper region including a connection area with the pilot valve 5 and a lower region close to the floor F, wherein the upper region has a large diameter while the lower region has a small diameter. Hence, if a large diameter is given to the entire cover member in conformity to the diameter of the upper region, the cover member may slack in its lower section, which causes deterioration in visual quality. Inversely, if a small diameter is given to the cover member in its wrapped state in order to suppress the occurrence of the slack, the bending and stretching movement of the over-floor portions 10 involved by the rotational movement of the console box applies a mechanical load, particularly, to an interconnection portion, that is, a portion where both wrapping ends of an upper section of the cover member are interconnected; this results in the possibility that the interconnection of the wrapping ends is released.

SUMMARY OF THE INVENTION

It is an object of the present invention to provide an operation unit for a construction machine, which unit comprises a floor, an operation seat provided on the floor and a console box provided on a lateral side of the operation seat and allows a plurality of hoses arranged from the floor to the console box to be adequately covered at a low cost. It is also an object of the present invention to provide a hose cover suitable for covering the hoses.

In addition to the floor, the operation seat and the console box, the operation unit of the present invention comprises: a pilot valve provided within the console box; a plurality of hoses connected to the pilot valve and arranged at least in an area from the pilot valve to the floor while being bundled together; and a flexurally deformable hose cover covering a plurality of over-floor portions which are respective portions of the hoses between the pilot valve and the floor. The over-floor portions are arranged so as to form a bundle having a greater diameter on the side of the pilot valve than on the side of the floor. The hose cover includes a sheet-shaped cover member having opposite wrapping ends and being wrappable around the over-floor portions such that the wrapping ends are interconnected, and a fastener adapted to join the wrapping ends together to hold the cover member in a tubular shape. The cover member has an upper cover section which covers a region of the over-floor portions on the side of the pilot valve and a lower cover section which covers a region of the over-floor portions in an area below the upper cover section, and is wrapped around the over-floor portions in such a shape that the upper cover section has a diameter greater than that of the lower cover section.

DESCRIPTION OF THE PREFERRED EMBODIMENTS

An embodiment of the present invention will be described with reference to FIGS. 1 to 9.

Figure 1:
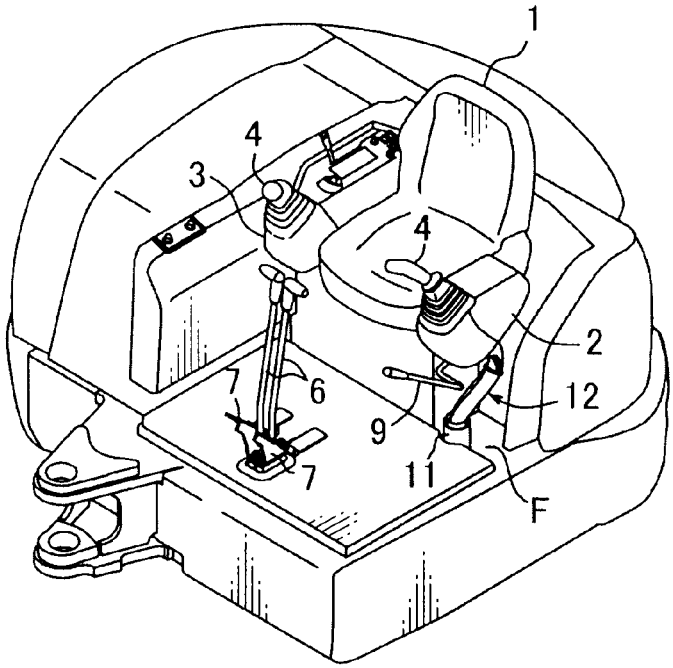
FIG. 1 is a perspective view showing an upper slewing body of a hydraulic shovel in one embodiment of the present invention.
Figure 2:
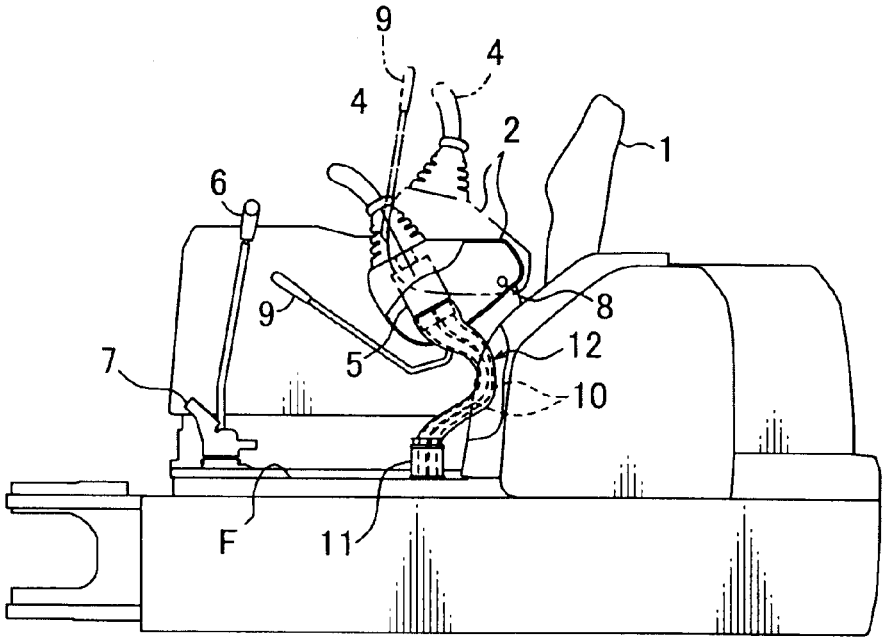
FIG. 2 is a partially cut-away side view showing the upper slewing body.

FIGS. 1 and 2 show an upper slewing body of a hydraulic shovel, which is an open type having an operation unit exposed to the outside. This operation unit comprises a floor F, an operation seat 1 provided above the floor F, and two console boxes 2 and 3 provided on left and light sides of the operation seat 1, respectively. Each of the console boxes 2 and 3 is provided with a working manipulation device comprising a control lever 4 and a pilot valve 5 adapted to be operated by the control lever 4. Furthermore, a control lever 6 and a pedal 7 are provided on the floor F at a position in front of the operation seat 1.

The left console box 2 of the two console boxes 2 and 3, which is so positioned as to face an entrance, is disposed so as to prevent the console box 2, particularly the control lever 4 thereof, from disturbing getting-on or getting-off operators. Specifically, the console box 2 is supported rotationally movably about a pivot shaft 8 shown in FIG. 2, between a lowered position for a working mode, indicated by the solid line in FIG. 2, and a lifted position for a getting-on/off mode, indicated by the two-dot chain line in FIG. 2. The lifted position is located upward and rearward of the lowered position to open up the entrance. The console box 2 is set to the lifted position during getting-on/off.

There is provided a gate lever 9 on a left front side of the operation seat 1. The gate lever 9 is able to be swung in a frontward-rearward direction, like a barrier for a railroad crossing, to open and close the entrance. Specifically, the gate lever 9 is operated so as to close the entrance during working and open the entrance during getting-on/off. The gate lever 9 is generally coupled to the left console box 2 through an interlocking mechanism for interlocking between the gate lever 9 and the console box 2, thus being automatically opened and closed interlockingly with lifting and lowering of the console box 2.

The operation unit further comprises a plurality of hoses. Each of the hoses has one end connected to the pilot valve 5 within the left console box 2 and the other end connected to a control valve, a pump and a tank provided at a position away from the pilot valve 5, e.g., in an equipment compartment on a right side of the upper slewing body. On the floor F is provided a hose guide 11, which is formed in a tubular shape to guide each of the hoses from the upper side of the floor F to the lower side thereof.

FIGS. 1 and 2 illustrate only two of the over-floor portions 10, for the sake of simplification, while the number thereof is typically six.

This embodiment further involves a hose cover 12 for covering the over-floor portions 10. As shown in FIGS. 5 to 9, the hose cover 12 has a sheet-shaped cover member 13 having opposite wrapping ends and being wrappable around the over-floor portions 10 with an interconnection of the wrapping ends, and a plurality of tape fasteners (such as hook and loop fasteners or Velcro fasteners) 16 as fasteners adapted to interconnect the wrapping ends to hold the cover member 13 in a tubular shape.

Figure 8:
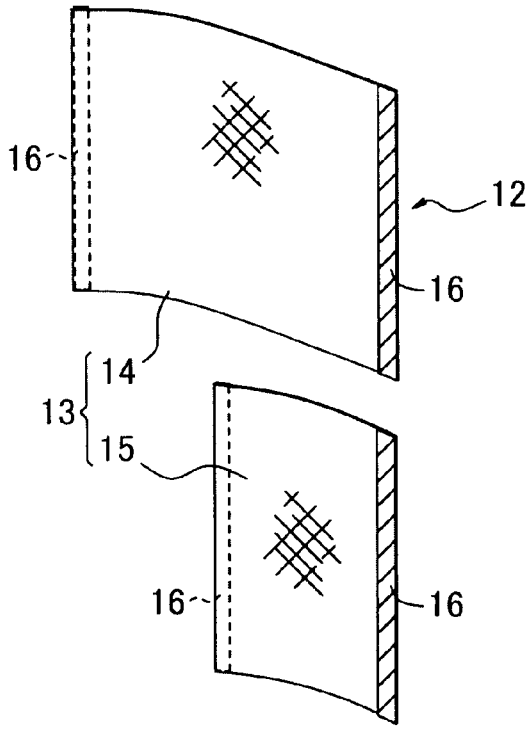
FIG. 8 is a perspective view showing an upper member and a lower member which make up a hose cover according to the embodiment.
Figure 9:
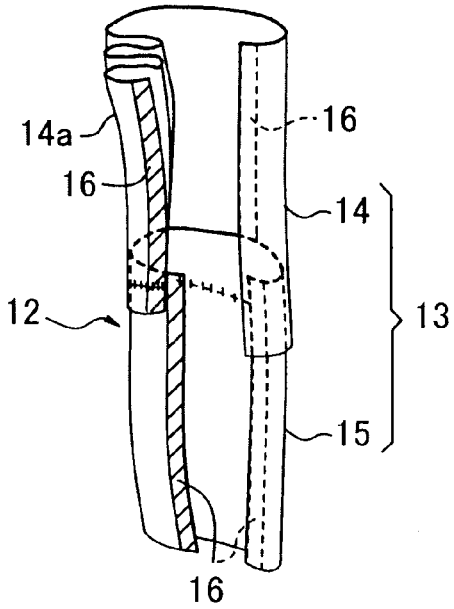
FIG. 9 is a perspective view showing the assembled hose cover.
Figure 10:
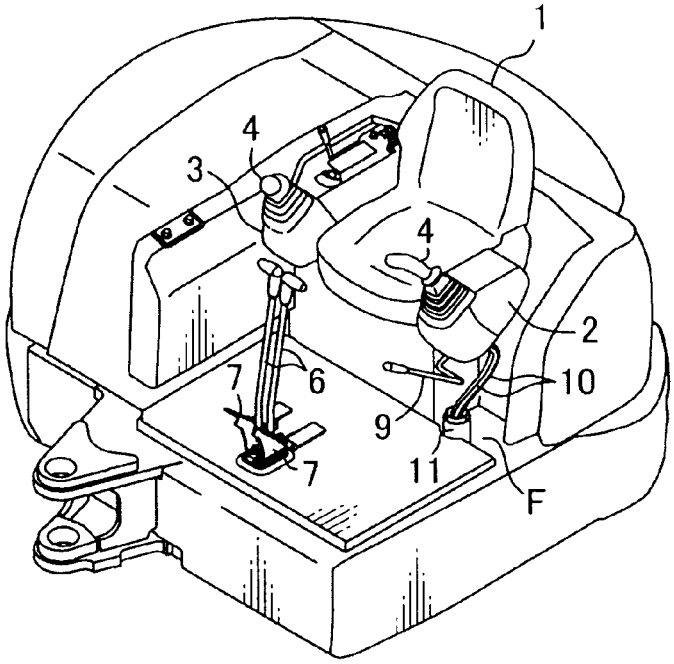
PRIOR ART FIG. 10
FIG. 10 is a perspective view showing a conventional upper slewing body of a hydraulic shovel.
Figure 11:
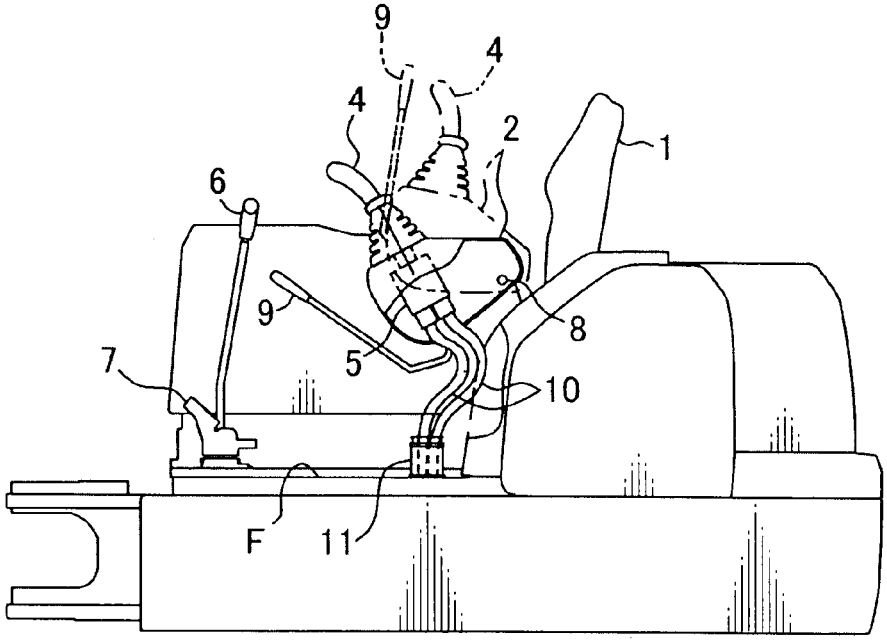
PRIOR ART FIG. 11
FIG. 11 is a partially cut-away side view showing the conventional upper slewing body.

In this embodiment, the cover member 13 comprises an upper member 14 and a lower member 15 as shown in FIGS. 8 and 9. Each of the upper and lower members 14, 15 is a flexibly deformable rectangular-shaped sheet member, such as a synthetic resin sheet or a leather sheet. The upper member 14 makes up an upper cover section which covers a region of the over-floor portions 10 on the side of the pilot valve 5, and the lower member 15 makes up a lower cover section which covers a region of the over-floor portions 10 below the upper cover section. A lower end of the upper member 14 and an upper end of the lower member 15 are superimposed on each other so as to position the upper member 14 outside the lower member 15 and align one of widthwise opposite ends of the upper member 14 with one of widthwise opposite ends of the lower member 15, and, in this state, interconnected by means of sewing or heat sealing. Thus, the two members 14, 15 are substantially formed into a single sheet.

The upper member 14, which is wider than the lower member 15, has a portion widthwise protruding beyond the lower member 15, and this portion is folded into a shape having a plurality of pleats, that is, a zigzag shape, like a draped curtain, to thereby form a folded portion 14*a*. The folded portion 14*a* has a lower end, which is bound up, for example, by means of sewing, to allow an upper end of the folded portion 14*a* to be spread out like a fan while letting the lower end serve as a pivot.

Two couples of the tape fasteners 16 are fixed to the opposite wrapping ends, i.e., widthwise opposite sides, of each of the upper and lower members 14 and 15, respectively, for example, by means of sewing. In each of the upper and lower members 14 and 15, one of the couple of the tape fasteners 16 and 16 is fixed to an obverse side of the cover section while the other tape fastener 16 fixed to a reverse side thereof. When the cover member 13 is wrapped around the over-floor portions 10, the couple of the tape fasteners 16 are engaged with each other to interconnect the two wrapping ends. Thus, the cover member 13 is wrapped around the over-floor portions 10 so that the upper member 14 covers the region of the over-floor portions 10 on the side of the pilot valve 5 and has a diameter greater than that of the lower member 15, i.e., so as to be formed into a diameter-varied cylindrical shape which has a greater diameter on its upper side than that on its lower side, to thereby cover the over-floor portions 10.

Figure 3:
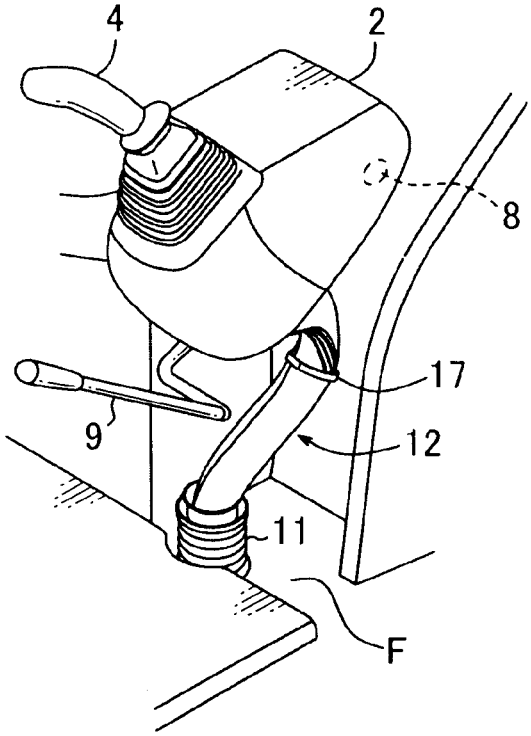
FIG. 3 is an enlarged view of an essential part of FIG. 1.
Figure 4:
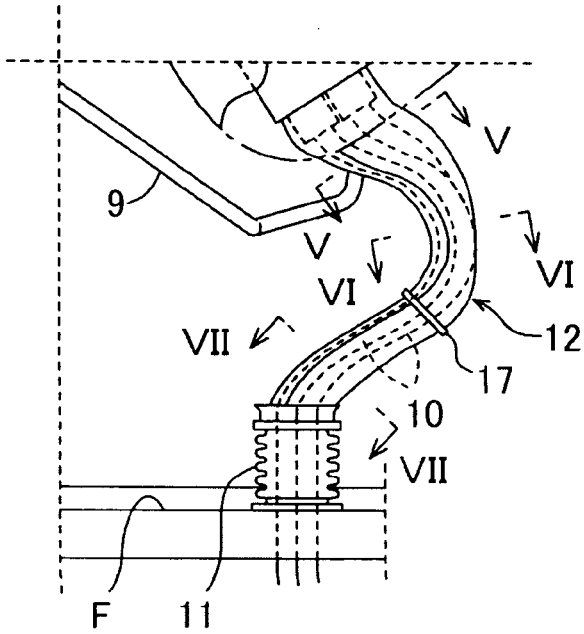
FIG. 4 is an enlarged view of an essential part of FIG. 2.

There may be attached a binding band 17, as shown in FIGS. 3 and 4, to an outer periphery of an appropriate region, e.g., an intermediate region, of the cover member 13, to bundle the over-floor portions 10 and the cover member 13.

Figure 5:
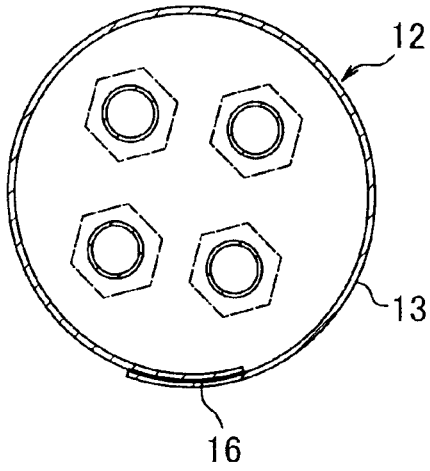
FIG. 5 is an enlarged sectional view taken along the line V-V in FIG. 4.
Figure 6:
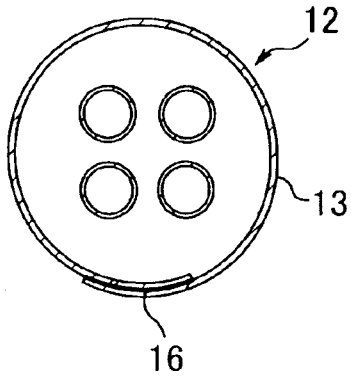
FIG. 6 is an enlarged sectional view taken along the line VI-VI in FIG. 4.
Figure 7:
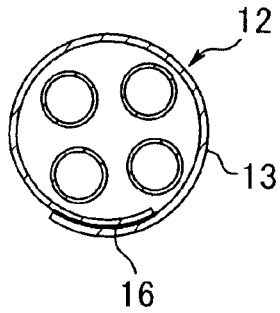
FIG. 7 is an enlarged sectional view taken along the line VII-VII in FIG. 4.

The cover member 13, where the upper cover section formed by the upper member 14 has a relatively great diameter appropriate to a diameter of the hose bundle including the connection area with the pilot valve 5 while the lower cover section formed by the lower member 15 has a relatively small diameter appropriate to a diameter of the hose bundle tied up in the vicinity of the floor F, can fit to the hose bundle formed of the over-floor portions 10 over the entire length of the cover member 13. Specifically, as shown in FIG. 5, FIG. 6 and FIG. 7, which illustrate respective cross-sections of an upper end, an intermediate portion and a lower end of the cover member 13, the cover member 13 has a diameter appropriate to the hose bundle consisting of the over-floor portions 10 in either of the cross-sections. In particular, the small diameter of the cover member 13 in its lower end shown in FIG. 7 reduces a redundant region in the lower end and suppresses a slack due to the redundant, thereby improving visual quality.

It should be noted that the cross-section of the cover member 13, which is illustrated as a perfect round shape in FIGS. 5 to 7 for the sake of convenience of illustration, actually has a shape slightly different from a perfect round shape.

Although, in this embodiment, the console box 2 is adapted to be rotationally moved about the horizontal pivot shaft 8 and the movement involves bending and stretching of the over-floor portions 10, a large load can be prevented from being applied to the tape fasteners 16, particularly to the upper tape fastener 16, regardless of the rotational movement of the console box 2, and thus release of the interconnection of the wrapping ends of the cover member 13 due to the load can be avoided.

Besides, the cover member 13 constituting the hose cover 12, being formed in a sheet shape and adapted to be wrapped around the hose bundle to cover the hose bundle, can lower cost as compared with the first conventional technique and suppress the damage due to contact between the cover member 13 and the over-floor portions 10.

Furthermore, the hose cover 12 according to this embodiment and the structure including the hose cover enables the following advantageous effects to be obtained.

(A) The upper cover section of the cover member 13, including the folded portion 14*a* expandable and contractible like a folding fan, is able to be reasonably and naturally formed into a tubular shape with a diameter gradually decreasing in a direction from an upper section to a lower section of the cover member 13. Thus, the cover member 13 is able to more reliably fit to the upper region of the over-floor portions 10. This enhances the effect of preventing the cover member 13 from slack and the effect of preventing the hoses from damage, and further improves visual quality.

(B) Since the cover member 13 comprises the rectangular-shaped lower member 15 and the rectangular-shaped upper member 14 wider than the lower member 15 and is integrally formed by joining the lower end of the upper member 14 with the upper end of the lower member 15, the production of the cover member 13 requires no newly prepared and dedicated special cutting die and can be performed by utilization of an existing cutting die, differently from the cases where, for example, the cover member is formed of a single sheet cut in an irregular shape. This results in further reduction in the cost.

(C) The lower end of the upper member 14 and the upper end of the lower member 15, being superimposed on each other and interconnected so as to position the lower end of the upper member 14 outside the upper end of the lower member 15, can reliably prevent foreign substances such as dust from intruding into the cover member 13 through the interconnection portion.

The present invention is not limited to the above embodiment. For example, the present invention may further include the following embodiments.

(1) The cover member according to the present invention may be formed of a single sheet. This sheet may have a shape obtained by combining the upper member 14 and the lower member 15, or may be an inverted trapezoidal shape whose width gradually decreases in a downward direction and capable of being formed into a truncated cone shape when the sheet is wrapped around the over-floor portions 10. In the latter case, a hose cover may be formed similarly to the cover member 13 in the above embodiment, for example, by providing the tape fasteners 16 on widthwise opposite sides of the sheet, respectively.

(2) In the present invention, a fastener to be fixed to the cover member is not limited to the tape fastener 16, but may be any other suitable type, such as a zipper, a claw hook, a button hook, or a combination of a button and a buttonhole.

(3) The present invention, though being particularly effective in an operation unit equipped with a rotationally movable console box, can be applied to an operation unit equipped with a non-movable console box. Also in this case, the invention makes it possible to suppress the slack of the cover member constituting the hose cover to thereby improve visual quality, and fit the cover member to the over-floor portions to suitably constrain the hose bundle and thereby suppress wobbling of each of the hoses due to machinery vibration, etc., and unbundling of the hoses due to the wobbling.

(4) The present invention may be also applied to a hydraulic shovel with a cabin. Furthermore, not limited to a hydraulic shovel, the present invention may be widely applied to an operation unit for any other suitable type of construction machine, wherein the operation unit comprises a floor, an operation seat, a console box and a plurality of hoses each including an over-floor portion.

As mentioned above, the present invention provides an operation unit for a construction machine, which comprises: a floor; an operation seat provided on the floor; and a console box provided on a lateral side of the operation seat, and allows a plurality of hoses arranged from the floor to the console box to be adequately covered at a low cost. The present invention also provides a hose cover suitable for covering the hoses.

In addition to the floor, the operation seat and the console box, the operation unit of the present invention comprises: a pilot valve provided within the console box; a plurality of hoses connected to the pilot valve and arranged at least in an area from the pilot valve to the floor while being bundled together; and a flexurally deformable hose cover covering a plurality of over-floor portions which are respective portions of the hoses between the pilot valve and the floor. The over-floor portions are arranged so as to form a bundle having a greater diameter on the side of the pilot valve than on the side of the floor. The hose cover includes a sheet-shaped cover member having opposite wrapping ends and being wrappable around the over-floor portions such that the wrapping ends are interconnected, and a fastener adapted to join the wrapping ends together to hold the cover member in a tubular shape. The cover member has an upper cover section which covers a region of the over-floor portions on the side of the pilot valve and a lower cover section which covers a region of the over-floor portions in an area below the upper cover section, and is wrapped around the over-floor portions in such a shape that the upper cover section has a diameter greater than that of the lower cover section.

In this unit, the cover member can be formed such that the upper cover section thereof has a relatively large diameter appropriate to a diameter of the upper region of the hose bundle including a connection area with the pilot valve while the lower cover section thereof has a relatively small diameter appropriate to a diameter of the hose bundle tied up in the vicinity of the floor. The cover member is therefore able to fit to the hose bundle over its overall length. This suppresses a slack of the cover member to thereby improve its visual quality. Even in the case where the console box is rotationally movable between a lowered position for an operation mode of the construction machine and a lifted position located rearward of the lowered position to open up an entrance and the over-floor portions of the hoses are arranged so as to be bent and stretched along with the rotational movement of the console box, it becomes possible to prevent the interconnection of the wrapping ends from release thereof due to the bending and stretching. Furthermore, the cover member, being formed in a sheet shape and adapted to be wrapped around the hose bundle to thereby cover the hose bundle, can lower the cost as compared with the first conventional technique and suppress damage due to contact between the cover member and the over-floor portions.

The present invention also provides a hose cover to be used in an operation unit for a construction machine, the operation unit including a floor, an operation seat provided on the floor, a console box provided on a lateral side of the operation seat; a pilot valve provided within the console box, and a plurality of hoses connected to the pilot valve and arranged at least in an area from the pilot valve to the floor, the hose cover being designed to cover a plurality of over-floor portions which are respective portions of the hoses between the pilot valve and the floor. Specifically, the hose cover comprises: a sheet-shaped cover member having opposite wrapping ends and being wrappable around the over-floor portions with an interconnection of the wrapping ends; and a fastener adapted to make the interconnection of the wrapping ends to hold the cover member in a tubular shape. The cover member has an upper cover section which covers a region of the over-floor portions on the side of the pilot valve and a lower cover section which covers a region of the over-floor portions below the upper cover section. The upper cover section has a width greater than that of the lower cover section so as to be able of to be wrapped around the over-floor portions in such a shape that the upper cover section has a diameter greater than that of the lower cover section.

This hose cover can adequately cover the over-floor portions of the hoses, as mentioned above.

In the hose cover of the present invention, it is preferable that: the upper cover section of the cover member has a portion widthwise protruding beyond the lower cover section; the protruding portion is folded into a plurality of pleats to form a folded portion; and the folded portion has a lower end which is bound to enable an upper end of the folded portion to be spread out like a folded fan. The folded portion enables the cover member to be formed reasonably and naturally in a tubular shape having a diameter gradually decreasing in a direction from the upper section to the lower section of the cover member and thus reliably fit to the upper region of the over-floor portions. This enhances the effect of preventing the lower section of the cover member from stack and the effect of preventing the hoses from damage, and further improves visual quality.

Although the cover member may be formed of a single sheet, it is more preferable that: the lower cover section is formed of a rectangular lower member; the upper cover section is formed of a rectangular upper member which is other than the lower member and has a width greater than that of the lower member; and a lower end of the upper member is joined to an upper end of the lower member such that the upper member widthwise protrudes beyond the lower member. This makes it unnecessary to prepare a new dedicated special cutting die possible and allows an existing cutting die to be utilized, differently from the case where the cover member is formed of a single sheet cut in a special shape. This results in reduction in the cost.

In this case, the lower end of the upper member and the upper end of the lower member are preferably interconnected so as to be superimposed on each other in inner and outer relation. This interconnection can prevent foreign substances such as dust from intruding into the cover member through the interconnection portion. This advantage becomes more significant when the lower end of the upper member is superimposed on the upper end of the lower member so as to be positioned outside the upper end of the lower member.

This application is based on Japanese Patent Application No. 2010-242295 filed on Oct. 28, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An operation unit for a construction machine, comprising:

a floor;

an operation seat provided on the floor;

a console box provided on a lateral side of the operation seat;

a pilot valve provided within the console box;

a plurality of hoses connected to the pilot valve and arranged at least in an area from the pilot valve to the floor while being bundled together; and a flexurally deformable hose cover covering a plurality of over-floor portions which are respective portions of the hoses between the pilot valve and the floor, the hose cover including: a sheet-shaped cover member having opposite wrapping ends and being wrappable around the over-floor portions with an interconnection of the wrapping ends; and a fastener adapted to make the interconnection of the wrapping ends to hold the cover member in a tubular shape, wherein:

the over-floor portions are arranged so as to form a bundle thereof having a greater diameter on the side of the pilot valve than on the side of the floor; and the cover member has an upper cover section which covers a region of the over-floor portions on the side of the pilot valve and a lower cover section which covers a region of the over-floor portions below the upper cover section, the cover member being wrapped around the over-floor portions in such a shape that the upper cover section has a diameter greater than that of the lower cover section, wherein the upper cover section of the cover member has a portion widthwise protruding beyond the lower cover section, the protruding portion being folded into a plurality of pleats to form a folded portion, and wherein the folded portion has a lower end bound to allow an upper end of the folded portion to be spread out like a folded fan.

2. The operation unit as defined in claim 1, wherein:

the console box is adapted to be rotationally moved between a lowered position for an operation mode of the construction machine and a lifted position located rearward of the lowered position to open up an entrance; and the over-floor portions of the hoses are arranged so as to be bent and stretched along with the swing movement of the console box.

3. A hose cover for use in an operation unit for a construction machine, the operation unit including: a floor; an operation seat provided on the floor; a console box provided on a lateral side of the operation seat; a pilot valve provided within the console box; and a plurality of hoses connected to the pilot valve and arranged at least in an area from the pilot valve to the floor, the hose cover being designed to cover a plurality of over-floor portions which are respective portions of the hoses between the pilot valve and the floor, the hose cover comprising: a sheet-shaped cover member having opposite wrapping ends and being wrappable around the over-floor portions with an interconnection of the wrapping ends; and a fastener adapted to make the interconnection of the wrapping ends to hold the cover member in a tubular shape, wherein the cover member has an upper cover section which covers a region of the over-floor portions on the side of the pilot valve and a lower cover section which covers a region of the over-floor portions below the upper cover section, the upper cover section having a width greater than that of the lower cover section so as to be wrapped around the over-floor portions in such a shape that the upper cover section has a diameter greater than that of the lower cover section, wherein the upper cover section of the cover member has a portion widthwise protruding beyond the lower cover section, the protruding portion being folded into a plurality of pleats to form a folded portion and wherein the folded portion has a lower end bound to allow an upper end of the folded portion to be spread out like a folded fan.

4. The hose cover as defined in claim 3, wherein:

the lower cover section is formed of a rectangular lower member;

the upper cover section is formed of a rectangular upper member which is other than the lower member and has a width greater than that of the lower member;

and a lower end of the upper member is joined to an upper end of the lower member such that the upper member widthwise protrudes beyond the lower member.

5. The hose cover as defined in claim 4, wherein the lower end of the upper member and the upper end of the lower member are interconnected so as to be superimposed on each other in inner and outer relation.

6. The hose cover as defined in claim 5, wherein the lower end of the upper member is superimposed on the upper end of the lower member so as to be positioned outside the upper end of the lower member.

* * * * *